US005445852A

United States Patent [19]

Sugai

[11] Patent Number: 5,445,852

[45] Date of Patent: Aug. 29, 1995

[54] METHOD OF COATING A SUBSTRATE WITH A COATING MATERIAL BY VIBRATING CHARGED PARTICLES WITH A ELECTRIC FIELD

[76] Inventor: Isao Sugai, 13-9, Enoki-cho, Tokorozawa-shi, Saitama-ken, Japan

[21] Appl. No.: 145,521

[22] Filed: Nov. 4, 1993

[30] Foreign Application Priority Data

Nov. 18, 1992 [JP] Japan ..... 4-308891

[51] Int. Cl.[6] ..... B05D 1/04; B05D 7/22; B05D 3/02

[52] U.S. Cl. ..... 427/474; 427/476; 427/475; 427/181; 427/190; 427/191; 427/192

[58] Field of Search ..... 427/474, 475, 565, 600, 427/181, 190, 191, 192, 476, 473

[56] References Cited

U.S. PATENT DOCUMENTS

| | | | |
|---|---|---|---|
| 2,742,185 | 4/1956 | Landry | 427/475 |
| 3,917,880 | 11/1975 | Wells et al. | 427/474 |
| 3,953,618 | 4/1976 | Muntz et al. | 427/474 |
| 4,780,331 | 10/1988 | Cobbs, Jr. et al. | 427/474 |

FOREIGN PATENT DOCUMENTS

| | | | |
|---|---|---|---|
| 234745 | 1/1969 | U.S.S.R. | 427/474 |
| 549504 | 3/1977 | U.S.S.R. | 427/600 |

*Primary Examiner*—Marianne Padgett
*Attorney, Agent, or Firm*—Oblon, Spivak, McClelland, Maier & Neustadt

[57] ABSTRACT

A method of coating a substrate, including the steps of: providing a space between an anode substrate constituting an anode and a cathode substrate constituting a cathode using an insulating member inserted between the anode substrate and the cathode substrate, supplying the providing space with particles of a coating material, preferably a metal or a metallic compound, evacuating the space, and generating an electric field in the evacuated space to cause vibration of the particles to coat the anode substrate and the cathode substrate with the particles of the coating material. According to the substrate coating method of the present invention, a coating with a high purity having excellent adhesion to a substrate and a uniform thickness can be formed on a substrate at normal temperatures at a high efficiency. Furthermore, according to the substrate coating method of the present invention, a coating can be formed on a substrate at a low electric power. Additionally, according to the substrate coating method of the present invention, a uniform coating can be formed on a substrate having a complicated shape.

13 Claims, 7 Drawing Sheets

METHOD OF COATING A SUBSTRATE WITH A COATING MATERIAL BY VIBRATING CHARGED PARTICLES WITH A ELECTRIC FIELD

BACKGROUND OF THE INVENTION

The present invention relates to a method of coating a substrate with a coating material, preferably a metal or a metallic compound, and an apparatus therefor.

Coating a coating material, preferably a substrate with a metal or a metallic compound, is generally conducted for corrosion protection, decoration, reinforcement and the like. The representative examples of methods of coating a substrate of the prior art include electroplating, vacuum evaporation and electrostatic spraying.

Electroplating is a method of depositing a metal by an electrochemical reaction on an electrode dipped in a plating solution. This technique has disadvantages such as the types of coating materials being limited and that a metal coating can only be formed on the order of a few microns. In addition, electroplating is not an economical method because it requires a complicated large-scale system and a large amount of electric power so that production cost is high. When a plating solution containing cyanogen, sodium hydroxide, or ammonia is used, plating efficiency and recovery rate of a coating material are low and waste disposal of the plating solution causes a serious pollution problem. In the case of melt plating, a melted coating material reacts with a substrate to be coated because the coating treatment is conducted at a high temperature.

Vacuum evaporation is a method of vacuum coating by heating a target material placed on a filament or in a crucible by a heating resistor, electron beam or scattered light from a laser, or by ion-sputtering of a target material. Although laser-heating and ion-sputtering can be conducted at a relatively low temperature compared with other vacuum evaporation techniques, they can not eliminate such disadvantages as a crucible causing contamination and coating materials reacting with one another or with a substrate so that an alloy is formed. In addition, since particles vacuum-evaporated or sputtered from a target are active and thus react with residual gas to generate impurities, a coating having high purity can not be obtained. Moreover, coating efficiency and recovery rate of a coating material are low. The coating obtained by this method has low adhesion to a substrate and is brittle. Furthermore, when a substrate having a large area is coated, a coating having a uniform thickness cannot be obtained.

Electrostatic spraying is a method of coating a substrate by spraying a coating solution from a nozzle onto a substrate. This method is simpler than the above two methods. However, electrostatic spraying has the disadvantages that a coating has low adhesion to a substrate and low density. In addition, this method is not economical because it requires special steps such as pre-washing of the substrate surface, pre-treatments for providing the substrate with adherability to a coating, a drying step and the like.

When a substrate in a complicated shape, for example, the inner surface of a hollow cylinder is coated, a uniform coating can not be obtained using any of the above methods.

SUMMARY OF THE INVENTION

Accordingly, an object of the present invention is to provide a method of coating a substrate and an apparatus therefor, which overcome the afore-mentioned disadvantages of the prior art.

Namely, an object of the present invention is to provide a method of coating a substrate and an apparatus therefor, which make it possible to efficiently form a coating having a uniform thickness and high purity at normal temperatures.

Another object of the present invention is to provide a method of coating a substrate and an apparatus therefor, which are useful in forming a coating having a large thickness.

A further object of the present invention is to provide a method of coating a substrate and an apparatus therefor, which make it possible to form a coating at a low electric power using a simple system.

Moreover, the object of the present invention is to provide a method of coating a substrate and an apparatus therefor, which are economical and free from pollution problems because a coating material can be recovered easily at a high recovery rate.

In addition, the object of the present invention is to provide a method of coating a substrate and an apparatus therefor, which is useful in forming a uniform coating on a substrate having a complicated shape.

BRIEF DESCRIPTION OF THE DRAWINGS

The present invention may be more fully understood with reference to the accompanying drawings and the following description of the embodiments shown in the drawings. The invention is not limited to the exemplary embodiments and it should be recognized that all modifications could be contemplated by one of ordinary skill in the art.

DESCRIPTION OF THE INVENTION

Figure 1:
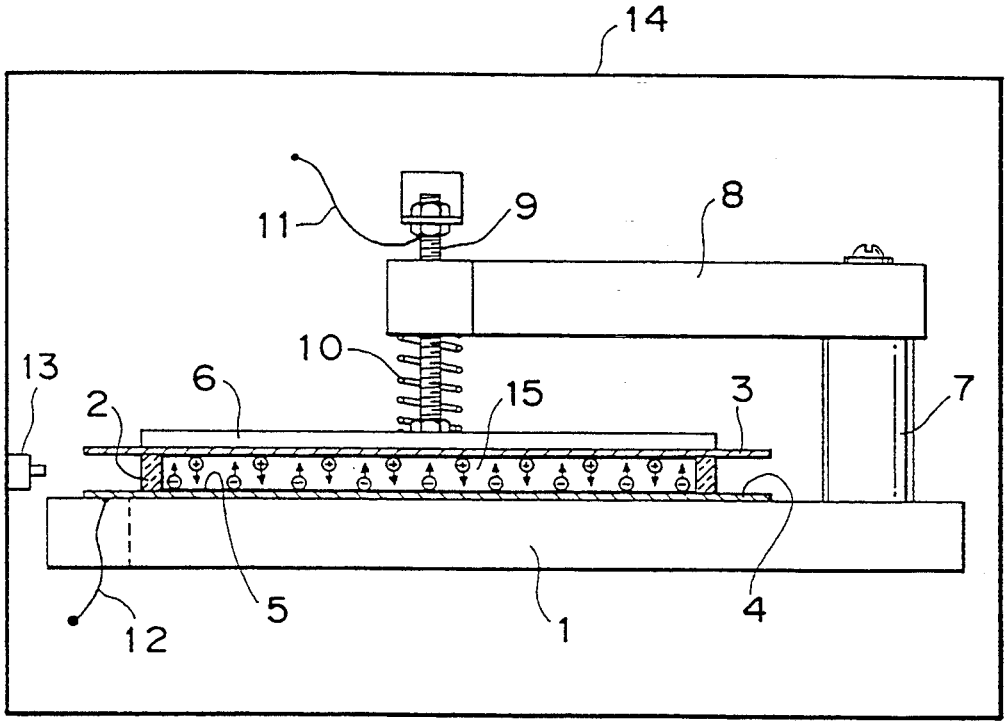
FIG. 1 is a diagrammatic sectional view of an embodiment of an apparatus for carrying out the substrate coating method of the present invention.

The inventor of this invention has conducted various studies to accomplish the foregoing objects, and has found that a coating can be formed on a substrate by: providing a space between an anode substrate constituting an anode and a cathode substrate opposite thereto constituting a cathode using an insulating member inserted between the anode substrate and the cathode substrate; supplying the provided space with particles of a coating material, preferably a metal or a metallic compound; evacuating the space; generating an electric field in the evacuated space to cause the vibration of the particles and thereby coating the anode substrate and the cathode substrate with the particles of the coating material. The foregoing steps constitute the present invention.

In addition, the present invention provides an apparatus for coating a substrate, comprising: a substrate constituting an anode; a substrate positioned opposite thereto constituting a cathode; an insulating member positioned between the anode substrate and the cathode substrate for providing an enclosed space between the anode substrate and the cathode substrate while keeping both substrates in electrically insulated conditions; vacuum means for evacuating at least the enclosed space; means for applying a voltage between the anode substrate and the cathode substrate to generate an electric field in the enclosed and evacuated space; and particles of a coating material, preferably a metal or a metallic compound, for being inserted into the enclosed space.

The method of the present invention will be hereinafter explained in detail.

The surface of the anode substrate and that of the cathode substrate are composed of a conductor or semi-conductor. The anode substrate and the cathode substrate may entirely consist of a conductor or semi-conductor. Alternatively, the surface of the substrate at a side facing the other substrate may be coated with a conductor or semi-conductor.

Examples of suitable conductors include iron, brass, copper, aluminum, stainless steel, molybdenum, tungsten and the like. Examples of suitable semi-conductors include silicon, germanium, non-metallic carbon and the like.

The shape of the anode substrate and that of the cathode substrate are not specifically limited. Typical examples of applicable shapes include a plane, cylinder, hollow cylinder, column, and other complicated shapes. When a coating having a uniform thickness is desired, a substrate having a shape of a plane, cylinder, hollow cylinder, or column is effective.

The anode substrate and the cathode substrate are positioned so as to be opposite to each other. According to the present invention, a coating amount can be varied by changing the distance between the anode substrate and the cathode substrate. Since the strength of an electric field generated between an anode and a cathode by the application of voltage is in inverse proportion to the distance between both electrodes, the energy imparted to particles contained in a space between both electrodes is also in inverse proportion to the distance between both electrodes. Accordingly, as the distance between the anode substrate and the cathode substrate is increased, a thinner coating is obtained and vice versa. For obtaining a coating having a uniform thickness, the anode substrate and the cathode substrate may be positioned so as to make the distance between both substrates uniform over the entire. In general, the anode substrate and the cathode substrate may be positioned at a suitable distance to generate a uniform electric field, preferably at a distance of from 0.5 to 3 cm.

An enclosed space containing particles of a metal or a metallic compound is provided between the anode substrate and the cathode substrate using an insulating member. The term "enclosed" means herein a condition in which a space provided between the anode substrate and the cathode substrate using an insulating member is sealed so that a coating material contained in the space does not leak, but it makes possible to evacuate the space to a desired degree. The enclosed space can be provided, for example, by inserting an insulating member in the shape of hollow cylinder between the anode substrate and the cathode substrate to separate the two substrates, or by holding the anode substrate and the cathode substrate opposite thereto by an insulating member at both sides of the anode substrate and the cathode substrate. The enclosed space may be provided in any other manner.

As an insulating member, any material can be used which can keep the anode substrate and the cathode substrate in an electrically insulated condition during the process of coating the substrates. Materials which are difficult to electrostatically charge are preferred because particles of a coating material are hardly deposited thereon. Examples of such materials include glass such as silica glass and pyrex glass, polytetrafluoroethylene, polyimide such as Kapton commercially available from Du pont Co., Ltd, organic materials such as pottery, and the like. Among them, glass such as silica glass and pyrex glass which has resistance to heat generated by discharge between the electrodes is preferred in respect of durability.

Particles of a coating material, preferably a metal or metallic compound, as a coating material is contained in the space provided between the anode substrate and the cathode substrate using the insulating member. Examples of suitable coating materials include beryllium, boron, carbon, aluminum, silicon, titanium, vanadium, chromium, manganese, iron, cobalt, nickel, copper, germanium, rubidium, yttrium, zirconium, niobium, molybdenum, ruthenium, rhodium, palladium, tin, hafnium, tantalum, tungsten, rhenium, osmium, iridium, lead, bismuth, stainless steel $Cr_2N$, TiN, TiC, CoCr, CoNi, $Al_2O_3$, TaN, NiCr, SiC and the like. Among these coating materials, silicon, chromium, manganese, nickel, germanium, molybdenum, palladium, tungsten, $Cr_2N$, CoCr and TaN are preferred because discharge is rarely caused between the particles thereof and thus they can stably form a coating. In addition to such an advantage, silicon has an advantage of being capable of being applied on the substrates of any materials at a high rate and nickel has a advantage of being capable of being applied on aluminum substrates at a high rate.

The suitable particle diameter of particles of the coating material is from 0.05 to 300 micrometers, preferably from 0.1 to 200 micrometers, and more preferably from 1 to 50 micrometers. If the particle diameter of the particles is smaller than 0.05 micrometers, they may not be vibrated by the application of a voltage between the anode and the cathode due to the conglomeration of the particles. If the particle diameter is larger than 300 micrometers, the vibration rate of the particles may become low so that a coating is not formed.

The shape of particles is not specifically limited. Typical examples of the shapes include a sphere, clump, drop, flake, irregular multi-cellular structure, irregular powder and the like.

The amount of the particles may be varied depending on the density of the particles. The amount of the particles for 1 $cm^2$ of the surface area of the substrate at a coating side is suitably from 0.1 to 50 $mg/cm^2$, preferably from 1 to 40 $mg/cm^2$, and more preferably from 5 to 30 $mg/cm^2$. If the amount of the particles is less than 0.1 $mg/cm^2$, a coating rate may be low. If the amount of the particles is more than 50 $mg/cm^2$, discharge may be caused between the anode and the cathode so that both electrodes are short-circuited.

After the enclosed space containing the coating material is provided between the anode substrate and the cathode substrate using the insulating member, the enclosed space is evacuated. The evacuation is conducted by directly evacuating the enclosed space using a vacuum pump, or by evacuating a vacuum chamber using a vacuum pump after providing the enclosed space in the vacuum chamber. The degree of vacuum may be not more than $10^{-2}$ torrs, preferably not more than $10^{-5}$ torrs. If the degree of vacuum is more than $10^{-2}$ torrs, discharge may be caused between the anode and the cathode so that both electrodes are short-circuited.

After the evacuating step, an electric field is generated in the evacuated space provided by the anode substrate and the cathode substrate using the insulating member by the application of a voltage between the anode substrate and the cathode substrate. The electric field should have sufficient strength to electrostatically charge the particles of the coating material as a coating material and then to cause a desired vibration of the particles between the anode substrate and the cathode substrate. Usually, it is preferred to generate an electric field having a strength of at least 2.5 kV/cm between the anode substrate and the cathode substrate for causing the desired vibration of the particles of the coating material.

Preferably, the strength of the electric field is gradually increased. By gradually increasing the strength of the electric field, the vibrating particles are accelerated, embedded in the anode substrate and the cathode substrate while repeating the vibration between the anode substrate and the cathode substrate, and built up so that a uniform continuous coating is eventually formed. If an electric field having a large strength is rapidly generated by the application of a large voltage between the anode substrate and the cathode substrate, a rapid generation of gas adsorbed on the microparticles and the surfaces of the substrates may occur so that discharge is caused between both electrodes. Accordingly, it is preferred to gradually increase the strength of the electric field generated in the enclosed and evacuated space to a desired strength. Usually, it is preferred to increase the strength of the electric field at a rate of from 0.1 to 0.5 kV/cm . min since the rapid generation of gas is inhibited.

The strength of the electric field is increased to a suitable final strength of from 3 to 30 kV/cm. If the final strength of the electric field is more than 30 kV/cm, it is difficult to cause the stable vibration of the particles and to thereby coat the substrate with the particles, because discharge is caused between both electrodes so that the electrodes are short-circuited. In the above range of the final strength of the electric field, a range of from 5 to 25 kV/cm is preferred, and a range of from 10 to 25 kV/cm is more preferred.

The voltage applied between both electrodes to generate the electric field can be direct or alternating. Direct voltage is preferred because the upper limit of alternating voltage obtained by a high alternating voltage source is low.

In the present invention, a coating of the mixture of different kinds of coating materials as well as a coating of a new compound (e.g., alloy) produced from coating materials can be formed on the substrate using different kinds of coating materials. These coating materials are contained together in the enclosed space.

In addition, a hybrid type of coating can be formed by repeating the above procedure of coating while changing the kind of metal or metallic compound.

Moreover, a substrate as an object to be coated can be coated with the particles of the coating material by setting the substrate in the enclosed space provided between the anode and the cathode using the insulating member. The substrate as an object to be coated is not specifically limited. Any materials including inorganic and organic materials having conductivity, semi-conductivity or insulation properties can be used as such substrates, provided that they do not generate gas which causes discharge during the formation of a coating. In this case, the substrate is preferably fixed in the enclosed and evacuated space provided between the anode and the cathode using the insulating member. For example, the substrate may be adhesively bonded on the anode or the cathode. The coating procedure for such a substrate is the same as described above.

According to the present invention, the anode substrate, the cathode substrate and/or the substrate set in the enclosed space provided between the anode and the cathode using the insulating member can be coated at normal temperatures. In general, these substrates can be coated at a temperature of from 0° to 50°C.

According to the present invention, the coating can be formed at an extremely low electric power such as 2 W/hour in comparison with the prior art such as an electroplating method or an electron-beam method. The electroplating method requires an electric power of about 30 W/hour, while the electron-beam method requires an electric power of about 400 W/hour.

The coating formed according to the method of the present invention has excellent adhesion to the substrates.

One embodiment of the present invention will be hereinafter explained in detail.

FIG. 1 is a diagrammatic sectional view of an embodiment of an apparatus for carrying out the substrate coating method of the present invention.

In FIG. 1, the apparatus for coating a substrate has a vacuum chamber 14, an anode substrate 3, a cathode substrate 4, and a ring insulating member 2 set in the vacuum chamber 14. The cathode substrate 4 is placed on a holder 1 of an insulating material. The anode substrate 3 is positioned so as to be parallel to the cathode substrate 4 and the insulating member 2 is inserted between the anode substrate 3 and the cathode substrate 4 to separate the two substrates. The distance between the anode substrate 3 and the cathode substrate 4 can be varied by changing the width of the insulating member 2. The anode substrate 3 is pressed on the insulating member 2 at a desired pressure by a spring 10 set in a free condition around a shaft 9 of a conductor through a press plate 6 of a conductor to provide an enclosed space 15 between the anode substrate 3 and the cathode substrate 4. A strut 7 is secured to the holder 1 and an arm 8 is screwed at one end to the strut 7. The shaft 9 is supported within the arm 8 in a free condition and screwed at one end to the press plate 6.

The anode substrate 3 and the cathode substrate 4 are connected to a high direct voltage source (not shown in FIG. 1) outside the vacuum chamber 14 through a voltage feed by means of a lead wire 11 and a lead wire 12, respectively. The vacuum chamber 14 is connected with a vacuum pump not shown in FIG. 1.

For observing the behavior of a coating material during the coating process, a YAG laser 13 is set so as to make scattered light pass between the anode substrate 3 and the cathode substrate 4.

When a substrate is coated using the apparatus illustrated in FIG. 1, a desired amount of particles 5 of a coating material is dispersed on the cathode substrate 4 in a desired manner. Then, the ring insulating member 2 is set on the cathode substrate 4, the anode substrate 3 is placed on the ring insulating member 2 and the press plate 6 is placed on the anode substrate 3 in that order. The enclosed space 15 is provided between the anode substrate 3 and the cathode substrate 4 using the insulating member 2 by applying a pressure to the press plate 6 by the spring 10.

Thereafter, the vacuum chamber 14 is evacuated to $10^{-4}$ torrs or below by a vacuum pump.

Subsequently, a desired voltage is applied between the anode substrate 3 and the cathode substrate 4 by a high direct voltage source not shown in FIG. 1. The voltage is increased at a desired rate to increase the strength of the electric field generated between the anode substrate 3 and the cathode substrate 4. When an electric field of at least 2.5 kV/cm is generated between both electrodes, the particles 5 of a coating material in the enclosed space 15 begin to vibrate between the anode substrate 3 and the cathode substrate 4. As the strength of the electric field is further increased, the vibration of the particles 5 becomes faster and the particles start to impact on the surface of the anode substrate and the surface of the cathode substrate so that they are embedded in the surfaces of the electrodes, built up and eventually form a coating. The strength of the electric field is maintained for a desired period of time after it reaches a desired strength. As a result, a continuous coating of a coating material can be obtained on the anode substrate 3 and the cathode substrate 4. After the pressure inside the vacuum chamber 14 is released to atmospheric pressure by introducing air into the vacuum chamber, the coated anode substrate and the coated cathode substrate are taken off. All of the unused particles can be easily collected.

Figure 2:
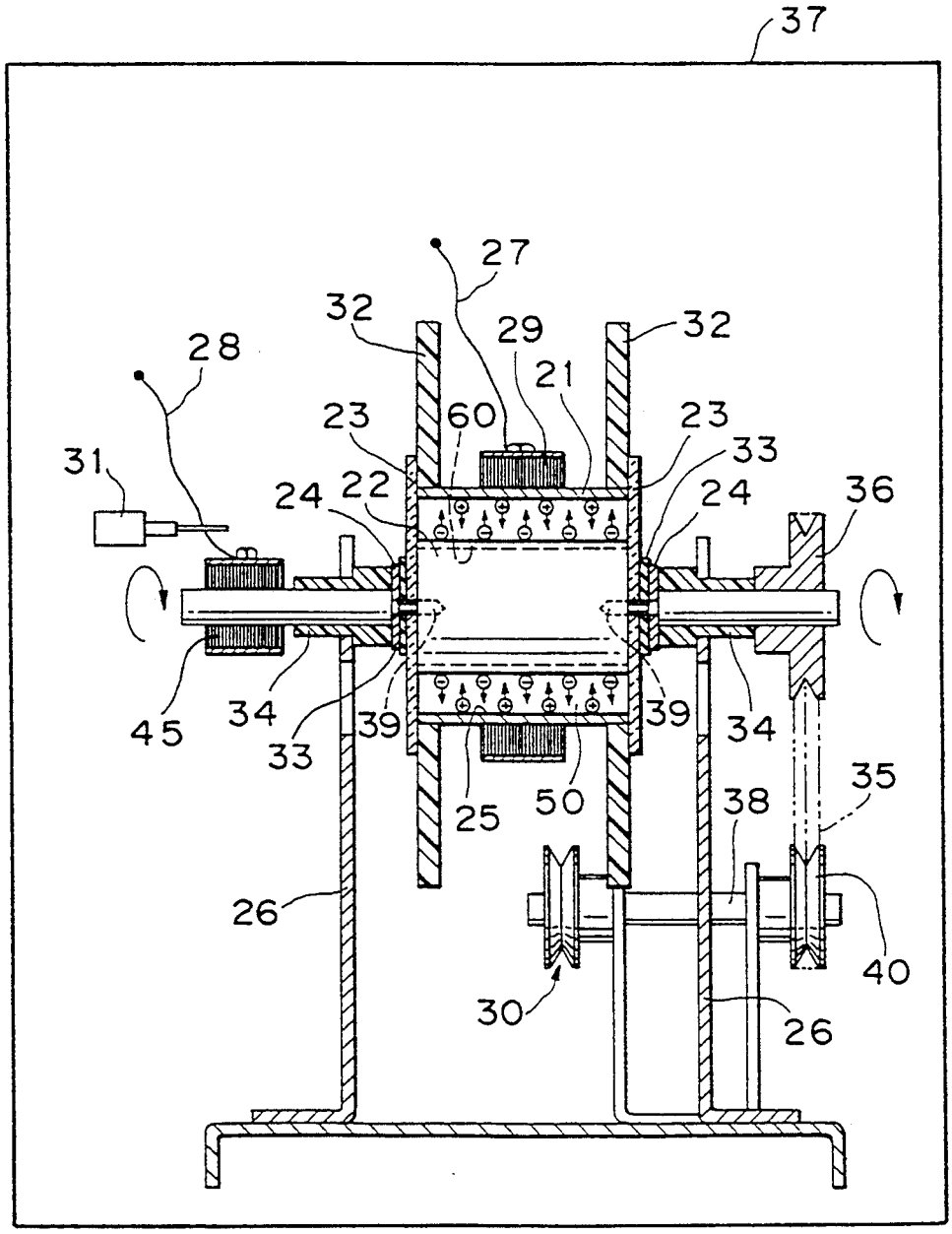
FIG. 2 is a diagrammatic sectional view of another embodiment of an apparatus for carrying out the substrate coating method of the present invention.
Figure 3:
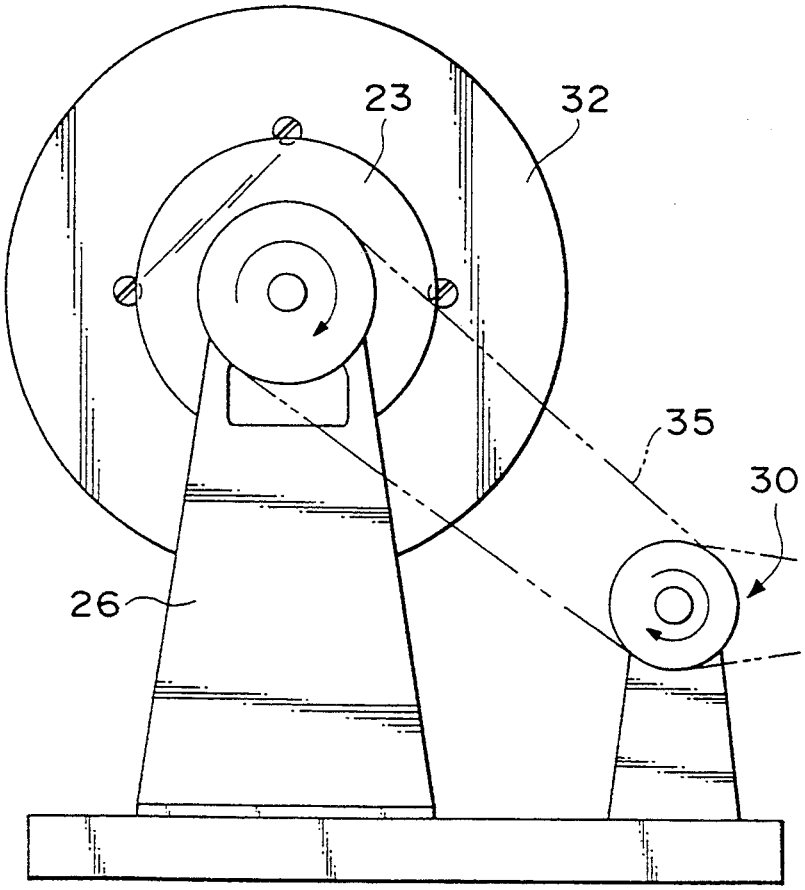
FIG. 3 is a diagrammatic side view of another embodiment of an apparatus for carrying out the substrate coating method of the present invention.

FIG. 2 is a diagrammatic sectional view of another embodiment of an apparatus for carrying out the substrate coating method of the present invention. FIG. 3 is a diagrammatic side view thereof.

In FIGS. 2 and 3, an apparatus for coating a substrate has a vacuum chamber 37, an anode substrate 21 in the shape of hollow cylinder, a cathode substrate 22 in the shape of cylinder and a pair of insulating discs 23 of an insulating material set in the vacuum chamber 37. A supporting column 60 is inserted within the cathode substrate 22 in the shape of cylinder so as to be in contact with the cathode substrate 22. The anode substrate 21 in the shape of hollow cylinder is inserted at opposite ends into discs 32. The cathode substrate 22 is interposed in the anode substrate 21 in the shape of hollow cylinder. A pair of discs 23 are set outside a pair of discs 32 so as to hold the anode substrate 21 and the cathode substrate 22. A pair of insulating discs 23 are pressed at a desired pressure by a shaft-supporting bar 39 through a pair of packing pieces 33 and a pair of press plates 24 to provide an enclosed space 50 between the anode substrate 21 and the cathode substrate 22. The shaft-supporting bars 39 are capable of being screwed at holes bored at the center of each the insulating disc 23 and at opposite sides of the central axis of the supporting column 60. The shaft-supporting bars 39 are supported by bearings 34 of a highly insulating material. One of the shaft-supporting bars 39 is connected to a pulley 36 and another shaft-supporting bar 39 is directly supported by a stand 26.

A pulley 40 is provided and connected to the pulley 36 by a belt 35. The pulley 40 is connected to a pulley 30 by a shaft 38 so as to be capable of rotating together with the pulley 30. The pulley 30 is connected through a belt not shown to a driving motor not shown in FIG. 2.

A lead wire 27 is connected with the anode substrate 21 through a carbon brush 29 and a lead wire 28 is connected with the cathode substrate 22 through a carbon brush 45. The lead wire 27 and the lead wire 28 are connected through voltage feeds with a high direct voltage source not shown in FIG. 2, positioned outside the vacuum chamber 37. The vacuum chamber 37 is connected with a vacuum pump not shown in FIG. 2.

For observing the behavior of a coating material during a process of coating the anode substrate 21 and the cathode substrate 22, a YAG laser 31 is set so as to make scattered light pass between the anode substrate 21 and the cathode substrate 22.

When a substrate is coated using the apparatus illustrated in FIGS. 2 and 3, a desired amount of particles 25 of a coating material is dispersed on the lower inner surface of the anode substrate 21 in a desired manner.

The supporting column 60 having tapped holes is inserted within the cathode substrate 22 in the shape of cylinder and then the anode substrate 21 and the cathode substrate 22 are held by the insulating discs 23. After the press plates 24, the discs 32 and the packing pieces 33 are set outside the insulating discs 23, the press plates 24 are pressed by screwing the shaft-supporting bars 39 into the tapped holes bored at the center of each planar side of the supporting column 60.

The above set shaft-supporting bars 39 are inserted into the bearings 34 and the whole above assembled apparatus is mounted on the stand 26. Subsequently, the carbon brushs 29 and 45 are set on the anode substrate 21 and the cathode substrate 22, respectively.

Then, the vacuum chamber 37 is evacuated to $10^{-4}$ torrs or below by a vacuum pump.

Subsequently, the anode substrate 21, the cathode substrate 22 and the insulating discs 23 are rotated at a rate of from 10 to 25 rpm by a driving motor not shown in FIGS. 2 and 3 through the pulley 30, a belt not shown, the pulley 40, the belt 35, the pulley 36 and the bearings 34. At the same time, a desired voltage is applied between the anode substrate 21 and the cathode substrate 22 by the high direct voltage source not shown. The applied voltage is increased at a desired rate to increase the strength of the electric field generated between the anode substrate 21 and the cathode substrate 22. As a result, the particles 25 of a coating material in the enclosed space 50 begin to vibrate between the inner surface of the anode substrate 21 and the outer surface of the cathode substrate 22 in an electric field of at least 2.5 kV/cm. As the strength of the electric field is further increased, the vibration becomes faster. After the strength of the electric field reaches a certain value, the strength of the electric field is maintained for a desired period of time. As a result, the particles of a coating material are embedded in the inner surface of the anode substrate 21 and the outer surface of the cathode substrate 22 and built up so that the coating is formed on the inner surfaces of the anode substrate 21 and on the outer surface of the cathode substrate 22.

It is believed that the method of coating a substrate according to the present invention is based on the principle explained below.

When a certain strength of electric field is generated in an enclosed space containing particles of a metallic compound and being provided between an anode substrate and a cathode substrate using an insulating member inserted therebetween, the particles are electrostatically charged by contact charging to the same polarity as that of the electrode contacting with said particles so that the particles are repelled to the opposite electrode. If the applied voltage is low, the electrostatic charging amount is small so that only small particles can be repelled to the opposite electrode because of the effects of gravity. If the applied voltage is high, large particles can be repelled to the opposite electrode. When the particles impact on the opposite electrode, they are electrostatically charged to the opposite polarity and repelled back towards the electrode from where they started. Such a process is repeated. Thus, the particles appear to "vibrate". Such vibration of the particles can be usually observed in an electric field of at least 2.5 kV/cm. If the applied voltage is increased, the electrical charge of the particles is increased so that kinetic energy is increased. At an electric field strength of at least about 5 kV/cm, the particles are embedded in both of the electrodes and built up so that a coating of the particles is formed. If the applied voltage is increased further to generate a stronger electric field, the coating rate of the particles is increased. Usually, when a strength of an electric field is more than 30 kV/cm, the strength of a surface electric field reaches a discharge value and thus the electrodes are short-circuited so that the particles can not vibrate.

Usually, when the particles are accelerated with the obtained high energy at an electric field strength of from 3 to 30 kV/cm, they repeatedly impact on the opposite electrode substrates and are gradually built up thereon so that a coating is formed on the electrode substrates.

In vacuum evaporation, sputtering and electroplating processes, the particles of a coating material are deposited by impacting on a substrate with an average kinetic energy of a few eV, several tens of eV and several hundreds of eV, respectively. In contrast, in the method of the present invention, the particles of a coating material can be deposited on a substrate by impacting on the substrate with a kinetic energy of at least $10^5$ eV. For example, particles having a particle diameter of 10 micrometers can be deposited on a substrate by impacting on the substrate with a kinetic energy of at least 200 keV at an electric field strength of 20 kV/cm. As a result, a coating having excellent adhesion to a substrate can be obtained.

The present invention will be explained in more detail with reference to the following non-limiting working examples.

EXAMPLE 1

An iron plate was coated with manganese at normal temperatures using the substrate coating apparatus shown in FIG. 1.

An iron plate of 17 cm×17 cm×3 mm as a cathode substrate 4 was placed on a holder 1 of Teflon. Manganese particles having an average particle diameter of 10 micrometers (1.35 g) were dispersed uniformly on the iron cathode substrate 4. For the measurement of a temperature of the substrate, a thermocouple of copper-constantan having a diameter of 0.5 mm connected with a model TR-2112A digital multithermometer (Advantest Co., Ltd.) was welded to the iron cathode substrate 4. A pyrex glass ring having a diameter of 150 mm $\phi$, a thickness of 5 mm and a height of 10 mm as an insulating member 2 was set on the iron cathode substrate 4 at a predetermined position. An iron plate of 17 cm×17 cm×3 mm as an anode substrate 3 was placed on the pyrex glass ring insulating member 2 so as to hold the pyrex glass ring insulating member 2 together with the iron cathode substrate 4 and to be parallel to the iron cathode substrate 4.

A press plate 6 of aluminum having a diameter of 150 cm and a thickness of 4 mm was set on the iron anode substrate 3.

A strut 7 of brass, an arm 8 of Teflon and a shaft 9 of brass were used. The press plate 6 was pressed by a spring 10 at a pressure of 0.6 kg/cm$^2$ to provide an enclosed space 15.

Thereafter, the apparatus assembled above was set in a vacuum chamber 14 and the vacuum chamber 14 was evacuated to $10^{-6}$ torrs by a molecular pump.

Then, a direct voltage was applied between the parallel iron anode 3 and cathode 4 at an gradually increasing rate of 200 V/min (200 V/cm·min) to 2.5 kV. When the strength of an electric field reached 2.5 kV/cm, the manganese particles began to vibrate. The vibration of the manganese particles was confirmed by irradiating the manganese particles with a laser light from a YAG laser 13 and observing its scattered light.

The direct voltage of 2.5 kV was maintained as a finally applied voltage for 5 hours.

Then, dry air was introduced into the vacuum chamber 14 to make the pressure of the vacuum chamber 14 atmospheric pressure. The iron anode substrate 3 and the iron cathode substrate 4 were taken up. The average amount of coating formed on the anode substrate 3 and that formed on the cathode substrate 4 were measured by a direct-reading balance for digital analysis (trade name: Micro-type H33 available from Metler Co.).

The above procedure was repeated except that the finally applied voltage was set at 5, 10, 15, 20 and 25 kV (corresponding to an electric field strength of $0.5\times10^4$, $1.0\times10^4$, $1.5\times10^4$, $2.0\times10^4$ and $2.5\times10^4$ V/cm) to form a coating. The average coating amount of manganese was measured by a direct-reading balance for digital analysis.

Figure 4:
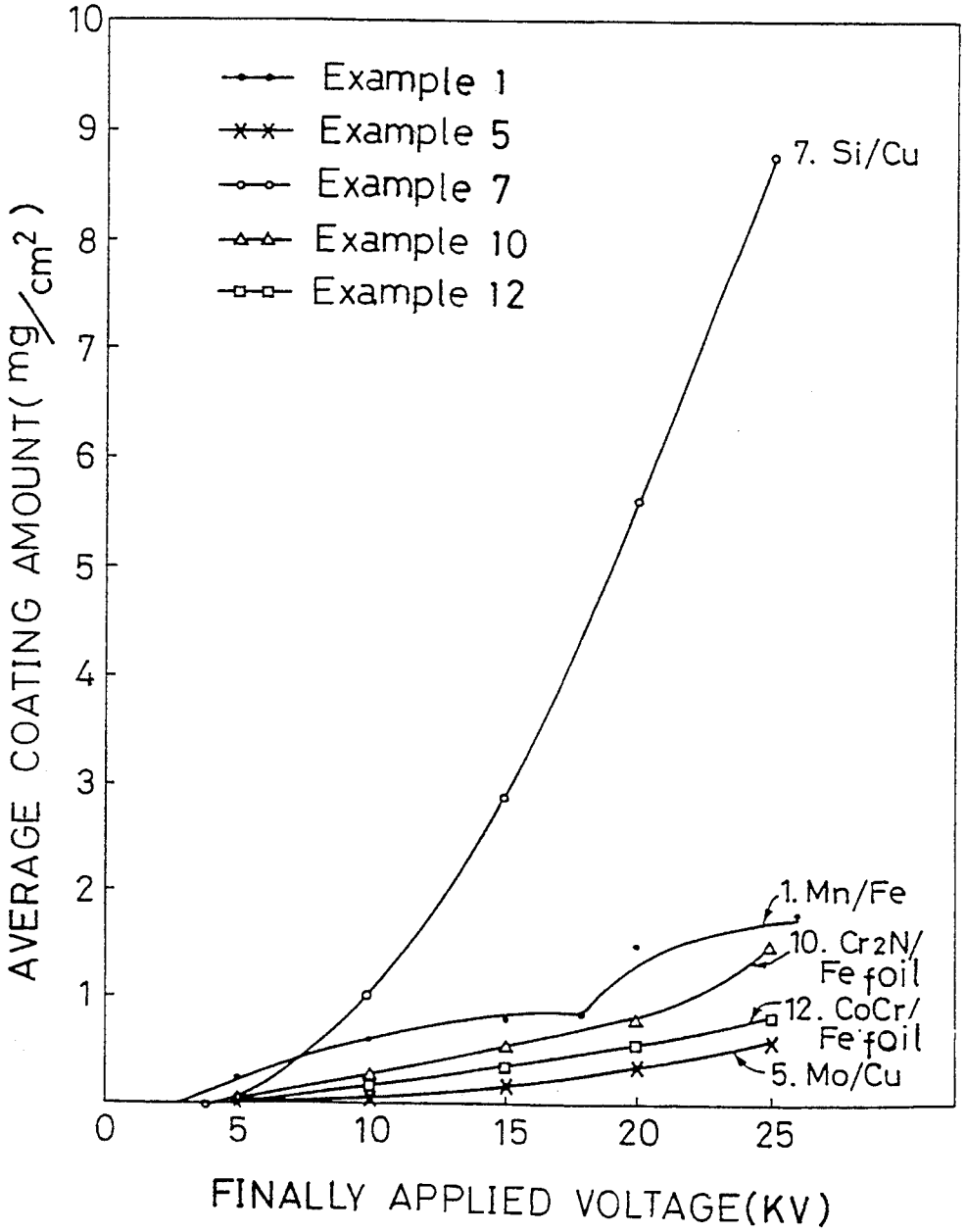
FIG. 4 is a graph showing a relationship between a finally applied voltage and an average amount of a coating in Examples 1, 5, 7, 10 and 12.

The results of the measurements are shown in FIG. 4. In FIG. 4, the average coating amount represented by a coating amount per unit area of the substrate (mg/cm$^2$) is plotted as the ordinate and the finally applied voltage applied between the anode substrate 3 and the cathode substrate 4 is plotted as the abscissa.

FIG. 4 shows that an increased finally applied voltage results in an increased coating amount. There was no significant difference between the amount of coating formed on the anode substrate and that formed on the cathode substrate. The distributions of the coating amounts were determined by a thickness indicator of Minitest 3001 type available from Sanko Electron Co. to be within ±10%. Therefore, it can be said that the obtained coatings are sufficiently uniform.

An electric power of about 1.4 kV/hour was used in the above procedure.

The measurement by the TR-2112A digital multithermometer reveals that the temperature of the iron cathode substrate 4 was maintained below 40° C. during the coating process.

Unused manganese particles could be seen on the anode substrate 3 and the cathode substrate 4 as well as on the insulating member 2 of glass ring around the position contacting with the anode substrate 3 and the cathode substrate 4. All of these unused manganese particles could be collected.

EXAMPLE 2

Figure 5:
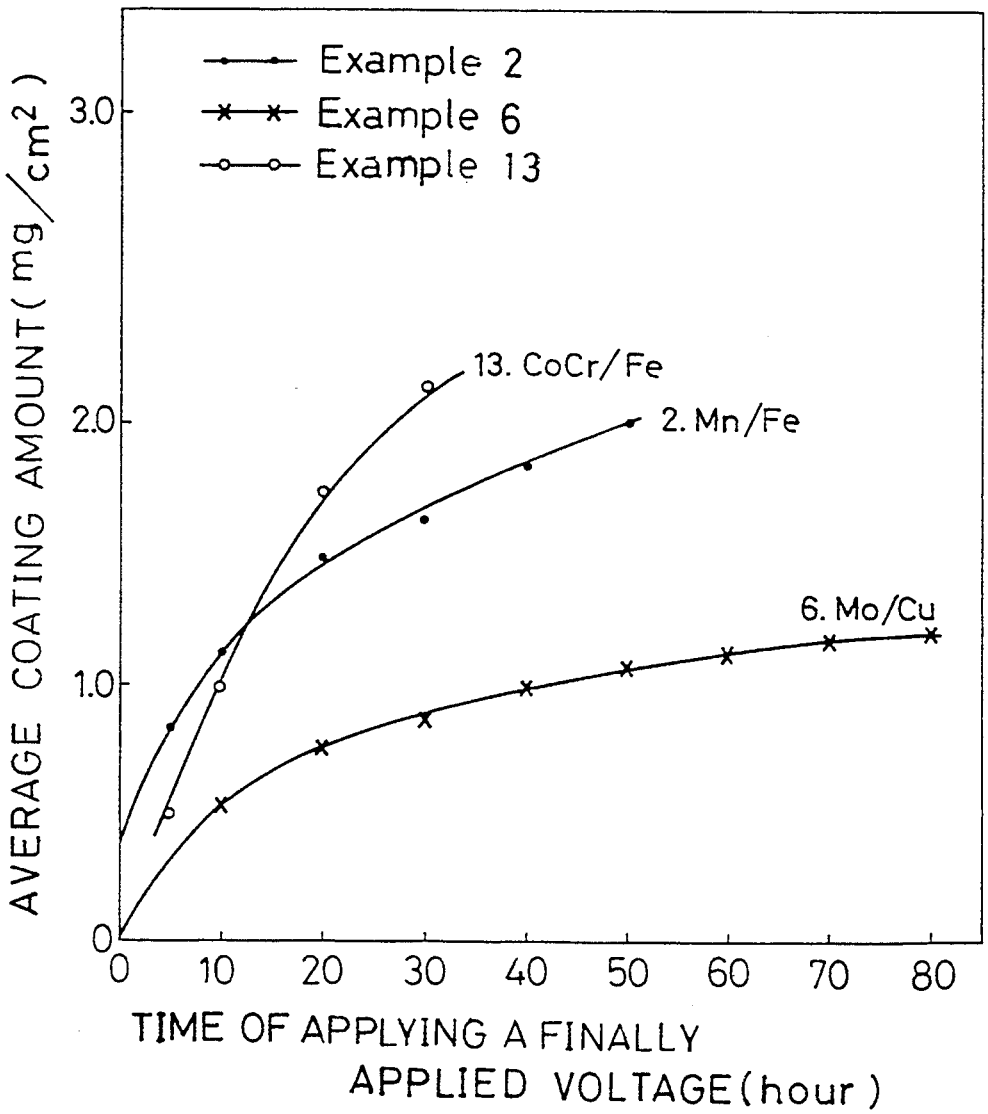
FIG. 5 is a graph showing a relationship between the application time of a finally applied voltage and an average amount of a coating in Examples 2, 6, and 13.

The procedure of Example 1 was repeated except that manganese particles having an average diameter of 10 micrometers (2 g) were used as a coating material, the finally applied voltage between the anode substrate 3 and the cathode substrate 4 was set at 20 kV (corresponding to an electric field of $2.0\times10^4$ V/cm), and the time of applying the finally applied voltage between the anode substrate 3 and the cathode substrate 4 was varied between 0 and 50 hours. The case where the finally applied voltage was zero corresponds to the case where the application of voltage was discontinued just before the applied voltage reached a certain value to be maintained as a finally applied voltage. During the application of the finally applied voltage, the vibration of the particles was stably continued. The amount of coating formed on the anode substrate 3 and that formed on the cathode substrate 4 were measured. The measurement was conducted by a direct-reading balance for digital analysis as in Example 1. The relationship between the time of applying the finally applied voltage and the coating amount was shown in FIG. 5. FIG. 5 shows that the coating amount was approximately proportional to the time of applying the finally applied voltage. There was no significant difference between the amount of coating formed on the anode substrate 3 and that formed on the cathode substrate 4. The distributions of the coating amounts were determined by a thickness indicator of Minitest 3001 type to be within ±5%.

When a finally applied voltage of 22.5 kV was applied for 1 hour, a coating of manganese in an average coating amount of 0.550 mg/cm$^2$ (corresponding to a thickness of 0.74 micrometers) was formed on each of the anode substrate 3 and the cathode substrate 4. The distributions of the coating amounts were determined by a thickness indicator of Minitest 3001 type to be within ±10%. Therefore, it can be said that the obtained coatings were sufficiently uniform.

EXAMPLE 3

The procedure of Example 2 was repeated except that copper foils of 15.0 cm×15.0 cm×30 micrometers were used as an anode substrate 3 and a cathode substrate 4 instead of the iron plates and the time of applying a finally applied voltage was set at 1 hour. A coating of manganese in an amount of 1.50 mg/cm$^2$ (corresponding to a thickness of 2.0 micrometers) was formed on each of the anode substrate 3 and the cathode substrate 4. The distributions of the coating amounts were within ±5%. Therefore, it can be said that the obtained coatings were sufficiently uniform.

EXAMPLE 4

A hollow pipe of brass and a cylinder of brass were coated with manganese at normal temperatures using the apparatus for coating a substrate shown in FIGS. 2 and 3.

Manganese particles having an average particle diameter of 10 micrometers (1 g) were uniformly dispersed around the lower center of a hollow pipe of brass having an outer diameter of 56 mm, an inner diameter of 50 mm and a length of 50 mm as an anode substrate 21. A supporting column 60 having a tapped hole of 3 mm $\phi$ at the center of each planar side was inserted within a cylinder of brass having a diameter of 30 mm and a length of 50 mm as a cathode substrate 22 and then the anode substrate 21 and the cathode substrate 22 were hold by an insulating member 23 of pyrex glass having a diameter of 70 mm and a thickness of 3 mm.

An aluminum disc having a diameter of 30 mm as a press plate 24, a disc of an acrylic resin having a diameter of 13 cm and a thickness of 5 mm as a disc 32 and a packing piece 33 of silicon were set on each of the insulating discs 23. The press plates 24 were pressed at a pressure of 0.8 kg/cm$^2$ by screwing a shaft-supporting bar 39 of SUS-304 in the tapped hole bored at the center of each planar side of the supporting column 60 to provide an enclosed space 50.

The shaft-supporting bars 39 were inserted into bearings 34 of Teflon and the whole apparatus set as above was held by a stand 26. Then, carbon brushs 29 and 45 were set on the anode substrate 21 and the cathode substrate 22, respectively.

The apparatus assembled above was set in a vacuum chamber 14 and the vacuum chamber 37 was evacuated to $10^{31\ 6}$ torrs by a molecular pump.

Then, the anode substrate 21, the cathode substrate 22, the insulating discs 23 and the discs 32 were rotated at a rate of from 10 to 25 rpm by a driving motor and a direct voltage of 1 kV was applied between the anode substrate 21 and the cathode substrate 22. The applied voltage was gradually increased at a rate of 200 V/min to 2.5 kV. When the strength of an electric field generated in the enclosed space 50 between the anode substrate 21 and the cathode substrate 22 reached 2.5 kV/cm, the manganese particles began to vibrate. The vibration of the manganese particles was confirmed by irradiating the manganese particles with a laser light from a YAG laser 13 and observing its scattered light.

The applied voltage was increased to 8 kV to generate an electric field of 8 kV/cm. The applied voltage of 8 kV was maintained for 1 hour as a finally applied voltage.

Then, dry air was introduced into the vacuum chamber 37 to make the pressure of the vacuum chamber 37 atmospheric pressure. The anode substrate 21 and the cathode substrate 22 were taken off. The average amount of the manganese coating formed on the inner surface of the anode substrate 21 and that of the manganese coating formed on the outer surface of the cathode substrate 22 were measured by a direct-reading balance for digital analysis. The above procedure was repeated except that the finally applied voltage was set at 10, 15, 20 and 25 kV (corresponding to an electric field of $1.0\times10^6$, $1.5\times10^4$, $2.0\times10^4$and $2.5\times10^4$ V/cm) to form a coating. The amount of manganese coating was measured by a direct-reading balance for digital analysis.

Figure 6:
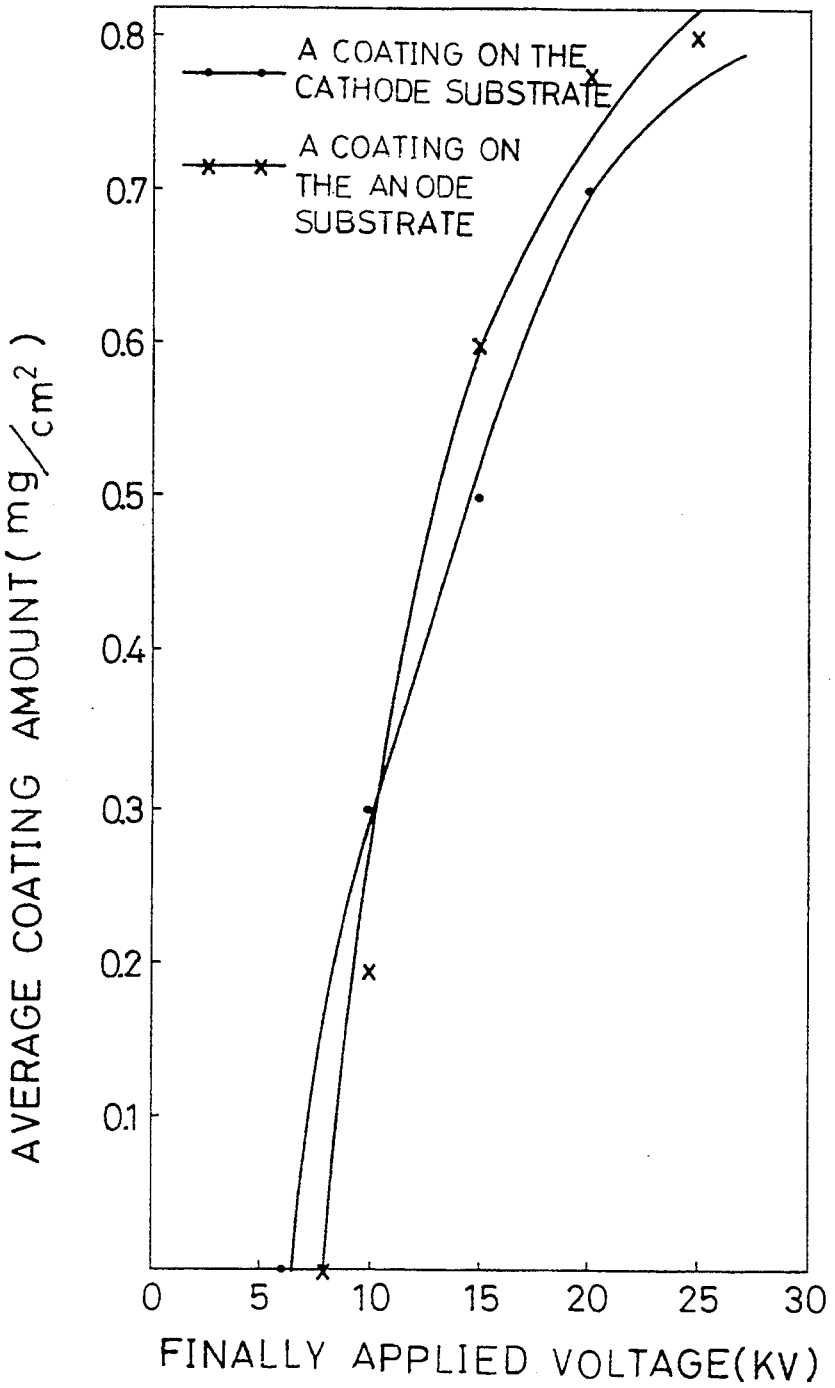
FIG. 6 is a graph showing a relationship between a finally applied voltage and an average amount of a coating in Example 4.

The results of the measurements are shown in FIG. 6. In FIG. 6, the average coating amount represented by a coating amount per unit area of the substrate (mg/cm$^2$) is plotted as the ordinate and the finally applied voltage applied between the anode substrate 21 and the cathode substrate 22 is plotted as the abscissa.

FIG. 6 shows that the increased finally applied voltage results in the increased coating amount.

An electric power of about 2 W/hour was used in the above procedure.

When a finally applied voltage of 22.5 kV was applied for 1 hour, a manganese coating in an average coating amount of 0.83 mg/cm$^2$ (corresponding to a thickness of 1.11 micrometers) was formed on the inner surface of the anode substrate 21 and a manganese coating in an average coating amount of 0.72 mg/cm$^2$ (corresponding to a thickness of 0.98 micrometers) was formed on the outer surface of the cathode substrate 22. The distributions of the coating amounts were within ±13%. Therefore, it can be said that the obtained coatings were sufficiently uniform.

The above procedure was repeated except that a thermocouple of copper-constantan having a diameter of 0.5 mm connected with a model TR-2112A digital multithermometer was welded to the brass cathode substrate 21 in a shape of hollow cylinder for the measurement of a temperature of the anode substrate 21 and the anode substrate 21, the cathode substrate 22, the insulating member 23 and the discs 32 were not rotated. The measurement by the TR-2112A digital multithermometer revealed that the temperature of the brass cathode substrate 21 was maintained below 40° C. during the coating process.

EXAMPLE 5

The procedure of Example 1 was repeated except that molybdenum particles having a particle diameter of from 2 to 5 micrometers (0.7 g) were used as a coating material and copper plates of 17 cm×17 cm×1 mm were used as an anode substrate 3 and a cathode substrate 4.

The results are shown in FIG. 4. FIG. 4 shows that an increased finally applied voltage results in an increased coating amount. There was no significant difference between the amount of coating formed on the anode substrate 3 and that formed on the cathode substrate 4.

EXAMPLE 6

The procedure of Example 2 was repeated except that molybdenum particles having a particle diameter of from 2 to 5 micrometers (0.7 g) were used as a coating material and copper plates of 17 cm×17 cm×1 mm were used as an anode substrate 3 and a cathode substrate 4.

The amounts of the coatings formed on the anode substrate and the cathode substrate 4 were measured. The relationship between the time of applying the finally applied voltage and the coating amount is shown in FIG. 5. FIG. 5 shows that the coating amount was approximately proportional to the time of applying the finally applied voltage. There was no significant difference between the amount of coating formed on the anode substrate 3 and that formed on the cathode substrate 4.

When a finally applied voltage of 20 kV was applied for 5 hours, a coating of molybdenum in an average coating amount of 0.4 mg/cm$^2$ was formed on the anode substrate 3. The distribution of the coating amount was determined by Minitest 3001 type to be within ±5%. Therefore, it can be said that the obtained coating was sufficiently uniform.

EXAMPLE 7

The procedure of Example 1 was repeated except that silicon particles of 325 meshes (1.0 g) were used as a coating material and copper plates of 17 cm×17 cm×2 mm were used as an anode substrate 3 and a cathode substrate 4.

The results are shown in FIG. 4. FIG. 4 shows that when a finally applied voltage was higher than 10 kV, a coating amount was drastically increased. There was no significant difference between the amount of coating formed on the anode substrate 3 and that formed on the cathode substrate 4.

EXAMPLE 8

The procedure of Example 3 was repeated except that silicon particles with an average particle size of 325 meshes (4.0 g) were used as a coating material, a copper plate of 17 cm×17 cm×2 mm was used as an anode substrate 3, a brass plate of 17 cm×17 cm×2 mm was used as a cathode substrate 4 and the time of applying a finally applied voltage was set at 5 hours.

The amount of the silicon coating formed on the anode substrate 3 was 13.5 mg/cm$^2$. The distribution of the coating amount was determined by a Minitest 3001 type thickness indicator to be within ±15%. Therefore, it can be said that the obtained coating was sufficiently uniform.

EXAMPLE 9

The procedure of Example 4 was repeated except that silicon particles with an average particle size of 325 meshes (1.0 g) were used as a coating material, a hollow pipe of copper was used as an anode substrate 21, a cylinder of copper was used as a cathode substrate 22 and the time of applying a finally applied voltage was set at 5 hours.

Figure 7:
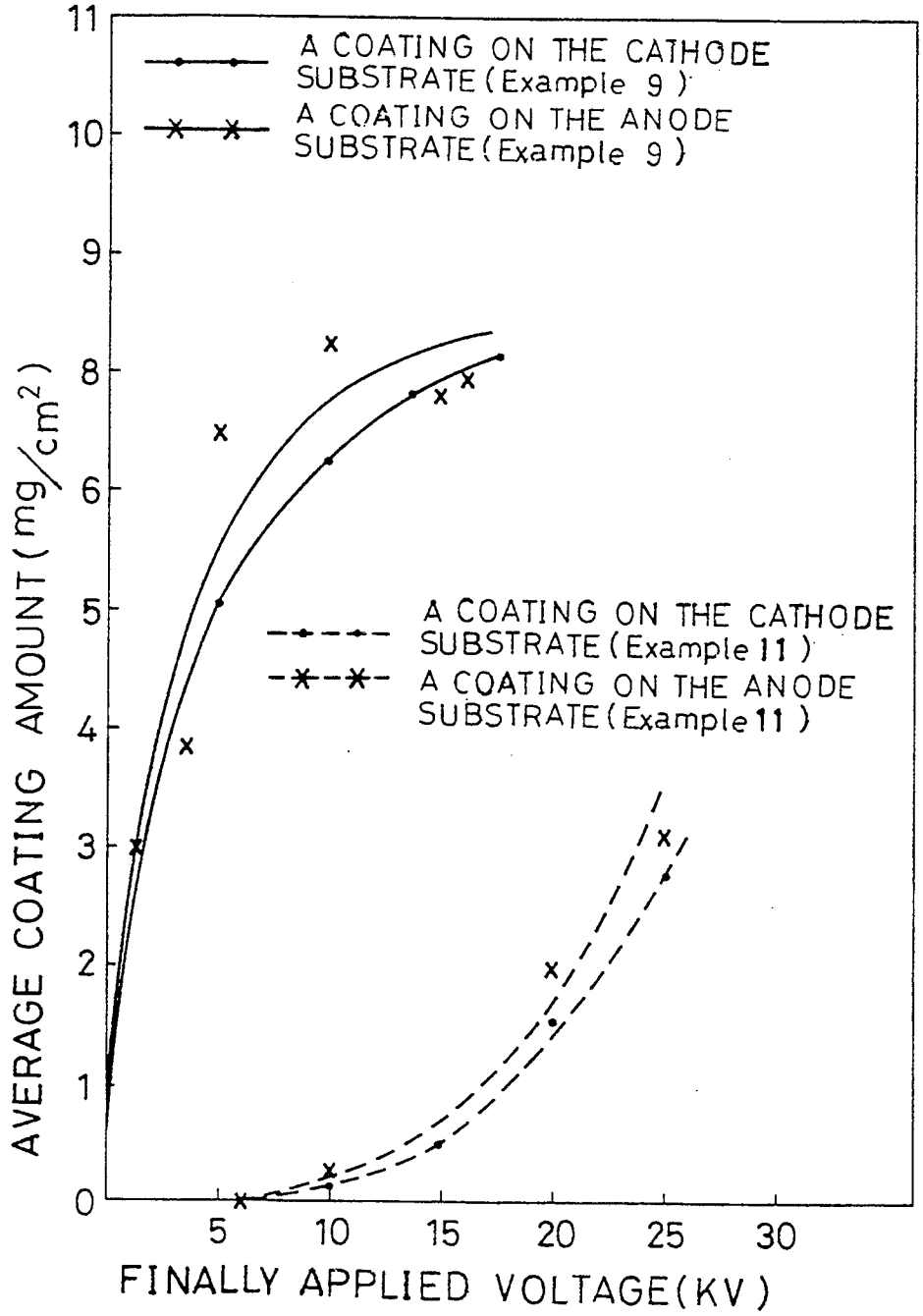
FIG. 7 is a graph showing a relationship between a finally applied voltage and an average amount of a coating in Examples 9 and 11.

The results are shown in FIG. 7. FIG. 7 shows that the coatings were formed at a high rate.

EXAMPLE 10

The procedure of Example 1 was repeated except that chromium nitride ($Cr_2N$) particles having an average particle diameter of 6.8 micrometers (0.7 g) were used as a coating material and iron plates of 17 cm×17 cm×0.5 mm were used as an anode substrate 3 and a cathode substrate 4.

The results are shown in FIG. 4. FIG. 4 shows that an increased finally applied voltage results in an increased coating amount. There was no significant difference between the amount of coating formed on the anode substrate 3 and that formed on the cathode substrate 4.

When a finally applied voltage of 20 kV was applied for 5 hours, a chromium nitride coating in an average coating amount of 0.8 mg/cm$^2$ was formed on the anode substrate 3. The distribution of the coating amount was determined by a Minitest 3001 type thickness indicator to be within ±10%. Therefore, it can be said that the obtained coating was sufficiently uniform.

EXAMPLE 11

The procedure of Example 4 was repeated except that tantalum nitride (TaN) particles having a particle diameter of from 2 to 5 micrometers (1.0 g) were used as a coating material and a finally applied voltage was applied for 5 hours.

The results are shown in FIG. 7. FIG. 7 shows that an increased finally applied voltage results in an increased coating amount.

When a finally applied voltage of 25 kV was applied for 5 hours, a tantalum nitride coating in an average coating amount of 3.0 mg/cm$^2$ was formed on the anode substrate 21. The distribution of the coating amount was determined by a Minitest 3001 type thickness indicator to be within ±15%. Therefore, it can be said that the obtained coating was sufficiently uniform.

EXAMPLE 12

The procedure of Example 1 was repeated except that CoCr particles having an average particle diameter of 45 micrometers (0.7 g) were used as a coating material and iron foils of 10 cm×10 cm×30 micrometers were used as an anode substrate 3 and a cathode substrate 4.

The results are shown in FIG. 4. FIG. 4 shows that when a finally applied voltage was higher than 10 kV, a coating amount was drastically increased. There was no significant difference between the amount of coating formed on the anode substrate 3 and that formed on the cathode substrate 4.

EXAMPLE 13

The procedure of Example 2 was repeated except that CoCr particles having an average particle diameter of 45 micrometers (0.7 g) were used as a coating material, iron foils of 10 cm×10 cm×30 micrometers were used as an anode substrate 3 and a cathode substrate 4 and the time of applying a finally applied voltage was varied between 0 and 30 hours.

The results are shown in FIG. 5. FIG. 5 shows that the coating amount was approximately proportional to the time of applying the finally applied voltage. There was no significant difference between the amount of coating formed on the anode substrate 3 and that formed on the cathode substrate 4.

When a finally applied voltage of 20 kV was applied for 5 hours, a CoCr coating in an average coating amount of 0.5 mg/cm$^2$ was formed on each of the anode substrate 3 and the cathode substrate 4. The distributions of the coating amounts were determined by a Minitest 3001 type thickness indicator to be within ±10%. Therefore, it can be said that the obtained coatings were sufficiently uniform.

EXAMPLE 14

The procedure of Example 4 was repeated except that silicon particles of 350 meshes (350 mg), manganese particles having an average particle diameter of 5 micrometers (200 mg) and palladium particles having an average particle diameter of 50 micrometers (50 mg) were used as coating materials, a hollow pipe of copper having an outer diameter of 56 mm, an inner diameter of 50 mm and a length of 50 mm was used as an anode substrate 21, a cylinder of copper having a diameter of 30 mm and a length of 50 mm was used as a cathode substrate 22 and a finally applied voltage of 20 kV was applied for 5 hours.

As a result, a coating in an average coating amount of 0.85 mg/cm$^2$ was formed on the inner surface of the anode substrate 21. The distribution of the coating amount was within ±18%. Therefore, it can be said that the obtained coating was sufficiently uniform.

EXAMPLE 15

The procedure of Example 3 was repeated except that tungsten particles having an average particle diameter of 1 micrometer (1.0 g) were used as a coating material, iron plates of 17 cm×17 cm×3 mm were used as an anode substrate 3 and a cathode substrate 4 and the time of applying a finally applied voltage was set at 5 hours. The above procedure was repeated using chromium particles having an average diameter of 7 micrometers (1.0 g), manganese particles having an average diameter of 5 micrometers (1.0 g) and germanium particles of 100 meshes (0.5 g) in that order.

As a result, a layered coating consisting of tungsten in an average coating amount of 0.80 mg/cm$^2$ chromium in an average coating amount of 1.02 mg/cm$^2$, manganese in an average coating amount of 0.61 mg/cm$^2$ and germanium in an average coating amount of 0.25 mg/cm$^2$ was formed on each of the anode substrate 3 and the cathode substrate 4. The distribution of the amount of coating formed on the anode substrate was within ±15%. Therefore, it can be said that the obtained coating was sufficiently uniform.

EXAMPLE 16

The procedure of Example 4 was repeated except that manganese particles having an average particle diameter of 5 micrometers (1.0 g) were used as a coating material and a finally applied voltage of 20 kV was applied between an anode substrate 21 and a cathode substrate 22 for 5 hours. The above procedure was repeated using iron particles having a particle diameter of from 5 to 10 micrometers (1.0 g), nickel particles having a particle diameter of from 2 to 12 micrometers (1.0 g) and silicon particles of 325 meshes (0.5 g) in that order.

As a result, a layered coating consisting of manganese in an average coating amount of 0.60 mg/cm$^2$, iron in an average coating amount of 0.60 mg/cm$^2$, nickel in an average coating amount of 0.10 mg/cm$^2$ and silicon in an average coating amount of 0.65 mg/cm$^2$ was formed on the anode substrate 21. A layered coating consisting of manganese in an average coating amount of 0.48 mg/cm$^2$, iron in an average coating amount of 0.60 mg/cm$^2$, nickel in an average coating amount of 0.10 mg/cm$^2$ and silicon in an average coating amount of 0.50 mg/cm$^2$ was formed on the cathode substrate 22. The distribution of the amount of coating formed on the anode substrate and that formed on the cathode substrate were within ±10%. Therefore, it can be said that the coatings formed on the anode substrate and the cathode substrate were sufficiently uniform.

EXAMPLE 17

The procedure of Example 3 was repeated except that chromium particles having an average diameter of 5 micrometers (135 mg) were used as a coating material, brass plates of 40 mm×40 mm×0.8 mm were used as an anode substrate 3 and a cathode substrate 4, a glass plate was bonded to the center of the anode substrate 3 with High Super S adhesive commercially available from Semedain Co. and the time of applying a final voltage applied was set at 3 hours.

As a result, a chromium coating in a coating amount of 0.20 mg/cm$^2$ was formed on the glass plate.

EXAMPLE 18

Stainless steel of 55 mm×100 mm×200 μm was minutely worked by photoetching to prepare a mask in which various patterns and characters were etched. The mask was fixed with an electrically conductive adhesive Doutaito commercially available from Fujikura Kasei Co., onto an aluminum plate having a diameter of 200 mm and a thickness of 1.5 mm. The procedure of Example 3 was repeated except that the mask-fixed aluminum plate was used as an anode substrate 3, an aluminum plate having a diameter of 200 mm and a thickness of 1.5 mm was used as a cathode substrate 4, nickel particles having a particle diameter of from 2 to 12 micrometers (1 g) were used as a coating material, and a finally applied voltage of 15 kV was applied for 1.5 hours.

As a result, a uniform masking pattern of nickel in a coating amount of 2.5 mg/cm$^2$ was formed on the anode substrate 3.

EXAMPLE 19

The mask prepared in Example 18 was fixed with an electrically conductive adhesive Doutaito commercially available from Fujikura Kasei Co., onto an iron plate having a diameter of 200 mm and a thickness of 0.5 mm. The procedure of Example 18 was repeated except that the mask-fixed iron plate was used as an anode substrate 3, an iron plate having a diameter of 200 mm and a thickness of 0.5 mm was used as a cathode substrate 4, chromium particles having an average particle diameter of 7 micrometers (0.8 g) were used as a coating material, and a finally applied voltage of 15 kV was applied for 3 hours.

As a result, a uniform masking pattern of chromium in a coating amount of 0.6 mg/cm$^2$ was formed on the anode substrate 3.

EXAMPLE 20

A piece of Scotch tape #W-18 commercially available from Sumitomo 3M Co., Ltd. was applied to each of the coatings formed in Examples 1–19 and peeled therefrom. No coatings were peeled off with the Scotch tape.

Each of the coatings formed in Examples 1–19 were bonded with an adhesive Araldite (Chiba-Geigy Co., Ltd.) to a side edge of a brass rod having a diameter of 10 mm and a length of 2 cm. A peel test was conducted by pulling the coating-bonded brass rod with a spring balance with a maximum tensile strength of 25 kg/cm$^2$. No coatings were peeled off in this peel test.

According to the substrate coating method and the apparatus therefor of the present invention, a coating having excellent adhesion to a substrate and good density can be obtained because the substrate is coated with particles having high energy.

According to the substrate coating method and the apparatus therefor of the present invention, a coating maintaining the characteristic properties of a coating material can be obtained because a substrate can be coated with the coating material at normal temperatures.

According to the substrate coating method and the apparatus therefor of the present invention, a coating can be obtained at a low electric power using a simple system.

According to the substrate coating method and the apparatus therefor of the present invention, a coating can be obtained with an extremely low loss of coating material because the coating is formed in an enclosed space and unused coating material can be easily collected at a high recovery rate. Therefore, the substrate coating method and the apparatus therefor of the present invention are economical and free from pollution problems.

According to the substrate coating method and the apparatus therefor of the present invention, a silicon coating can be formed on any substrate at a high rate and a nickel coating can be formed on an aluminum substrate at a high rate.

According to the substrate coating method and the apparatus therefor of the present invention, a uniform coating can be formed on the portion of a substrate having a complicated shape, such as the inner surface of a hollow cylinder and the outer surface of a column or cylinder.

According to the substrate coating method and the apparatus therefor of the present invention, a substrate can be coated with various kinds of coating materials having a high melting point such as tungsten, hafnium, beryllium, boron, carbon, titanium, palladium, molybdenum, iridium and rhenium because of the independency on the melting point of a coating material.

According to the substrate coating method and the apparatus therefor of the present invention, a coating of a mixture of different coating materials can be formed. Furthermore, a hybrid type of layered coating of different metals and/or different metallic materials can be formed.

According to the substrate coating method and the apparatus therefor of the present invention, a substrate can be coated with metallic compounds such as TaN and AlC, alloys and magnetic metals.

Therefore, the substrate coating method and the apparatus therefor of the present invention can be expected to be widely used in the engineering industry, electronics industry, vacuum science, accelerators, aircraft and space industry, marine development engineering, automotive industry and the like. Furthermore, the substrate coating method and the apparatus therefor of the present invention can be used in techniques for the preparation of functional coatings such as the reinforcement of surface characteristics, the improvement in service life of surfaces, the modification of surfaces and the like by selecting the kinds of coating materials having specific characteristic properties.

Although the invention has been described with reference to specific preferred embodiments, it is not limited thereto; rather, those skilled in the art will recognize that variations and modifications can be made which are within the spirit of the invention and within the scope of the claims.

I claim:

1. A method of coating an anode substrate and a cathode substrate with a coating material, comprising the steps of:

(a) separating said anode substrate and said cathode substrate via an insulating member to form an enclosed space therebetween;

(b) dispersing particles of said coating material on said anode substrate or said cathode substrate;

(c) evacuating atmosphere from said space via a vacuum pump; and (d) applying a voltage to said anode substrate and said cathode substrate to generate an electric field therebetween which causes vibration of said particles and thereby coats said anode substrate and said cathode substrate with said particles of said coating material.

2. The method according to claim 1, wherein said anode substrate and said cathode substrate are plates.

3. The method according to claim 1, wherein said anode substrate and said cathode substrate are cylinders positioned concentrically with one another.

4. The method according to claim 1, wherein said coating material is selected from the group consisting of beryllium, boron, carbon, aluminum, silicon, titanium, vanadium, chromium, manganese, iron, cobalt, nickel, copper, germanium, iridium, yttrium, zirconium, niobium, molybdenum, ruthenium, rhodium, palladium, tin, hafnium, tantalum, tungsten, rhenium, osmium, iridium, lead, bismuth, stainless steel, $Cr_2N$, TiN, TiC, CoCr, CoNi, $Al_2O_3$, TaN, NiCr, and SiC.

5. The method according to claim 1, wherein said particles have an average diameter in the range of 0.1 to 200 micrometers.

6. The method according to claim 1, wherein a strength of said electric field is increased at a rate of from 0.1 to 0.5 kV/cm.min to a strength sufficient to coat said anode substrate and said cathode substrate.

7. The method according to claim 1, wherein said electric field has a strength in the range of 3 to 30 kV/cm.

8. The method according to claim 1, wherein said space is evacuated to $10^{-2}$ torr or lower.

9. The method according to claim 1, wherein said electric field is generated to provide said particles with kinetic energy of at least $1\times10^5$ eV.

10. The method according to claim 1, wherein said insulating member is selected from the group consisting of glass, polytetrafluoroethylene, polyimide, and pottery.

11. The method according to claim 1, wherein said steps (a)–(d) are conducted at temperatures in the range of 0 to 50° C.

12. The method according to claim 1, wherein said particles are dispersed in an amount from 0.1 to 50 $mg/cm^2$ on said anode substrate or said cathode substrate.

13. A method of coating a substrate with a coating material, comprising the steps of:

(a) separating an anode substrate and a cathode substrate via an insulating member to form an enclosed space therebetween;

(b) inserting a substrate to be coated in said space between said anode substrate and said cathode substrate;

(c) dispersing particles of said coating material on said anode substrate or said cathode substrate;

(d) evacuating atmosphere from said space via a vacuum pump; and (e) applying a voltage to said anode substrate and said cathode substrate to generate an electric field therebetween which causes vibration of said particles and thereby coats said substrate to be coated with said coating material.

* * * * *